US007228800B2

(12) United States Patent
Leimand

(10) Patent No.: US 7,228,800 B2
(45) Date of Patent: Jun. 12, 2007

(54) DOCTOR BEAM HAVING A CORROSION-RESISTANT FIBER COATED CHANNEL

(75) Inventor: Henrik Leimand, Bjert (DK)

(73) Assignee: Tresu Anlæg A/S, Bjert (DK)

( * ) Notice: Subject to any disclaimer, the term of this patent is extended or adjusted under 35 U.S.C. 154(b) by 0 days.

(21) Appl. No.: 10/203,887

(22) PCT Filed: Feb. 14, 2001

(86) PCT No.: PCT/DK01/00097

§ 371 (c)(1),
(2), (4) Date: Aug. 26, 2002

(87) PCT Pub. No.: WO01/60619

PCT Pub. Date: Aug. 23, 2001

(65) Prior Publication Data

US 2003/0089256 A1 May 15, 2003

(30) Foreign Application Priority Data

Feb. 15, 2000 (DK) ..... 2000 00237

(51) Int. Cl.
*B41F 31/02* (2006.01)

(52) U.S. Cl. ..... 101/350.6; 101/363; 101/364

(58) Field of Classification Search ..... 101/350.6, 101/366, 348, 349.1, 350.1, 364, 207, 206, 101/205, 202, 208, 210; 423/447.1, 447.2
See application file for complete search history.

(56) References Cited

U.S. PATENT DOCUMENTS

| | | | | |
|---|---|---|---|---|
| 2,382,103 | A * | 8/1945 | Sandman | 101/365 |
| 4,080,735 | A | 3/1978 | Michalski | |
| 4,549,933 | A | 10/1985 | Judd et al. | |
| 4,594,106 | A * | 6/1986 | Tanaka et al. | 106/1.12 |
| 4,735,144 | A | 4/1988 | Jenkins | |
| 4,945,832 | A | 8/1990 | Odom | |
| 4,975,138 | A * | 12/1990 | Finlayson | 156/245 |
| 5,027,513 | A | 7/1991 | Allison, Jr. | |
| 5,341,737 | A * | 8/1994 | Marozzi et al. | 101/216 |
| 5,410,961 | A * | 5/1995 | DeNicola et al. | 101/363 |
| 5,671,673 | A * | 9/1997 | Boose et al. | 101/363 |
| 5,802,977 | A * | 9/1998 | Constantino et al. | 101/483 |
| 6,569,263 | B2 * | 5/2003 | Brown et al. | 148/253 |
| 6,617,019 | B2 * | 9/2003 | Danner et al. | 428/343 |

FOREIGN PATENT DOCUMENTS

| | | |
|---|---|---|
| CH | 685932 | 11/1995 |
| DE | 37 14327 | 11/1988 |
| DE | 197 25 056 | 4/1998 |
| DE | 197 25 061 | 4/1998 |
| EP | 0 246 708 | 11/1987 |
| EP | 0 732 205 | 2/1995 |
| EP | 0 908 309 | 4/1999 |
| EP | 0 999 043 | 5/2000 |
| JP | 10-34873 | 10/1998 |
| WO | WO 93/24328 | 12/1993 |

* cited by examiner

*Primary Examiner*—Leslie J. Evanisko
(74) *Attorney, Agent, or Firm*—James Creighton Wray

(57) ABSTRACT

A doctor beam (1) is provided for a doctor blade for application in a printing unit. The doctor beam comprises a U-shaped channel. At least the U-shaped channel (3), which is formed in a metal beam, is provided with a fibre coating (6) preferably made of carbon fibres. Hereby is achieved resistance against corrosive attack on the metal by cleaning agents and/or printing inks.

17 Claims, 1 Drawing Sheet

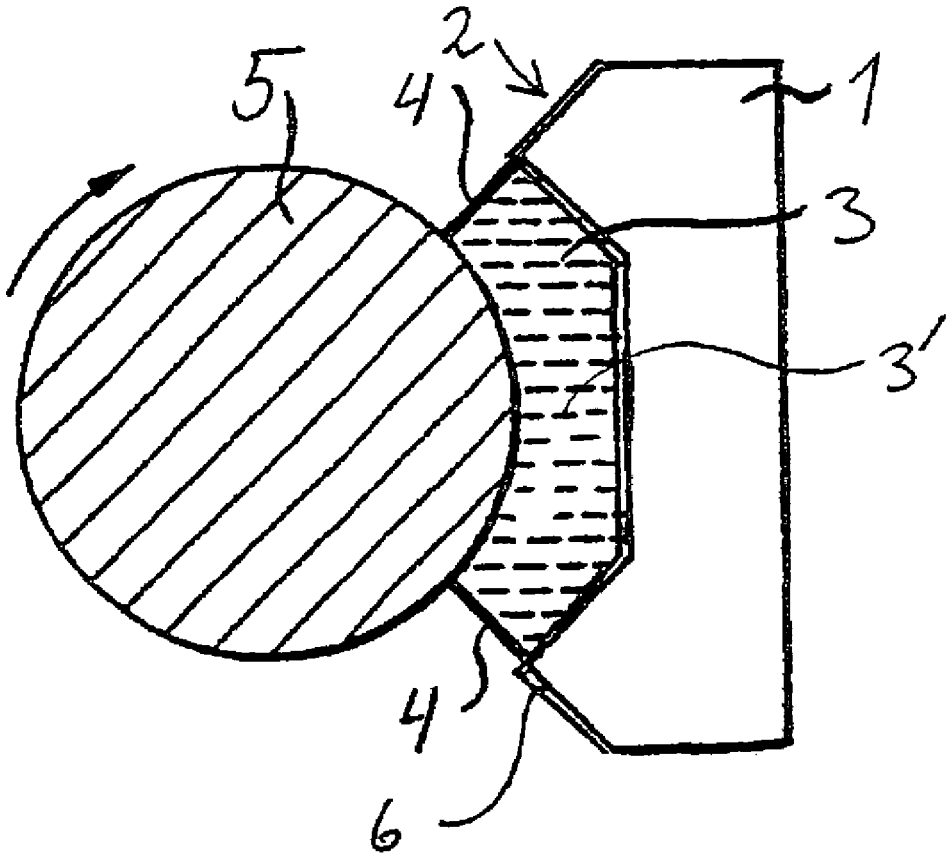
2
5
4
1
3
3'
4
6

DOCTOR BEAM HAVING A CORROSION-RESISTANT FIBER COATED CHANNEL

This application claims the benefit of Danish Application No. PA 2000 00237 filed Feb. 15, 2000 and PCT/DK01/00097 filed Feb. 14, 2002.

BACKGROUND OF THE INVENTION

The present invention concerns a doctor beam for a doctor blade for application in a printing unit, which doctor beam has a front side with a U-shaped channel constituting a part of the doctor blade chamber. The invention furthermore concerns a doctor blade for application in a printing unit and comprising a doctor beam with a front side with a U-shaped channel constituting a part of the doctor blade chamber.

Doctor blades are well-known for use in rotary flexographic printing, a printing method being particularly widespread within the packing industry. By flexographic printing, ink is transferred to paper, cardboard, plastic, metal film or similar print carrier by means of a rubber plate having a balanced amount of ink. The ink is transferred by means of a raster roller that today normally is a ceramically coated metal roller which has a multitude of tiny holes or cells, typically 10–100 μm deep, in its surface.

By varying the number of holes and hole depths it is possible to vary the amount of ink transferred and which is typically 3–25 g/m$^2$. In order to ensure that the holes are only filled to the rim, a doctor blade is scraping across the roller. This doctor blade is most often mounted in a closed ink supply system comprising a doctor blade. This is an elongate, closed chamber formed by the U-shaped channel, where at each side there is mounted doctor blades being in contact with the raster roller which forms one side of the chamber. At its ends, the chamber is closed by end walls or packings.

The doctor beam is usually made of metal, preferably aluminium, due to the mechanical properties desired in connection with chambers which may have lengths of one meter or more. Alternatively, doctor beams have also been made of plastic materials. These doctor blades however, have limited application due to the mechanical properties of the material.

Today, basic inks are used, thus causing the problem with corrosion of beams of aluminium. In order to relieve this, coating the beams with TEFLON, or at least their front side being in contact with aggressive inks, has been attempted. However, this is unfavourable as TEFLON is only partly pH-resistant. Alternatively, metal may be coated by nickel-plating or chromium-plating. This is, however, difficult if not impossible to do, particularly when the beam is of aluminium.

From DE-197 25 056 is known a doctor blade where a coating is provided on surfaces in order to achieve reduced friction. No solution to the problem with corrosion is indicated.

In spite of the widespread use of doctor blades, until now there has been no possibility for providing doctor beams with good mechanical properties and which at the same time are resistant against the chemical action from the applied inks, particularly for aluminium beams.

SUMMARY OF THE INVENTION

It is the purpose with the present invention to indicate a solution to these problems in a technically simple way as possible use of metal beams for making doctor blades without risk of these disintegrating due to chemical action of the applied inks.

According to the present invention, this is achieved with a beam of the kind mentioned in the introduction which is peculiar in that it is made of metal and has a fibre coating at least covering the U-shaped channel in order thereby to prevent disintegration due to chemical action of the applied ink.

The doctor blade according to the invention is peculiar in that the beam is made of metal and has a fibre coating at least covering the U-shaped channel in order thereby to prevent disintegration due to chemical action of the applied ink.

The fibre coating forms a protective coat preventing corrosive attack on the metal. Particularly, when the metal is aluminium there is achieved an advantage as a relatively light structure with good mechanical an chemical properties is attained.

An advantageous embodiment is peculiar in that the fibre coating comprises carbon fibres and possibly also glass fibres. These fibres have good resistance against the chemical compositions occurring in inks, varnishes, and the like used.

In order to get a particularly suitable and tight coating having well-defined mechanical properties, it is preferred that the fibre coating is formed by a braided fibre weaving. Hereby the coating can contribute to impart required mechanical strength to the beam.

In practice it has appeared advantageous that the applied coating preferably has a thickness between 0.1 mm and 5 mm, preferably between 0.5 mm and 1.5 mm. Such a coating may be applied under use of pressure and temperature which do not give rise to problems with different contraction coefficients during the coating process.

The fibre coating will usually be made so that it is resistant against basic colours and preferably with pH values over 8. However, the fibre coating is also resistant against acidic inks and may impart protection to aluminium beams against acidic action, preferably with pH-values under 6.

A doctor blade made with a doctor beam as described above will be relatively easy to make. Thus the doctor blades may easily be mounted on the front side of the beam even though this is provided with a fibre coating not only covering the U-shaped channel but also covering the parts of the front side at which the doctor blades are clamped In this situation, possible ink material penetrating behind the doctor blades in the interspace between doctor blade and beam will not give rise to corrosive action in these areas.

The fibre coating provided in connection with the beam may be made from a carbon fibre composite having the following properties:

Young's modulus for the ratio carbon fibre vs. resin: 140.000 (N/mm $^2$)

Specific weight: 1540 kg/m$^3$

Poisson ratio: 0.28 (carbon steel has 0.29, mild steel 0.30, aluminium 0.33)

Tensile strength: 550 MPa (225,000 psi)

Compressive strength: 890 MPa (129,000)

Secure operating temperature in wet or dry state is 55° C. However, resins may be used with raised temperature up to 80°.

Tests with carbon fibre composite with the said properties in connection with doctor blades with a cleaning solution called Stripper 303 and with NaOH, both at pH 14, showed the results below:

Stripper 303 at ambient temperature in 48 hours: no reaction

Stripper 303 at 50° C. in 10 hours: the chamber surface shows more pits than before the test Sporadic fibres could be seen in the surface.

NaOH cleaning solution at ambient temperature for 48 hours: no reaction.

NaOH at 50° C. for 10 hours: reaction corresponding to Stripper 303 but less aggressive.

During the experiment, no swelling or shrinking occurred in the composite after the performed tests. The mentioned temperatures can be raised to 80° C. with high temperature resins.

Experiments also showed that delamination of fibre coating only occurred by machining operations if the laminating had not been made correctly.

It appeared that 1 to 1.5 weight % water may be absorbed by the carbon fibre epoxy laminate in wet or dry conditions. In dry conditions, the process will go the opposite way without detrimental effects.

The composite material will not swell in normal use with standard inks or cleaning liquids. A very strong heat above the recommended temperatures may cause the epoxy to be burned and swell.

The thermal expansion coefficient for the carbon fibres is $0.4\times10^{-6}$. The thermal co-efficient of expansion for epoxy resin is $2.5\times10^{-6}$ in the direction of the fibre axis and in other directions $2.5\times10^{-5}$.

With these coefficients of expansion, no problems with differentiated thermal longitudinal expansion compared with aluminium during normal operating conditions for a doctor blade.

BRIEF DESCRIPTION OF THE DRAWING

In the accompanying drawings, a schematic section through a doctor blade comprising a doctor beam according to the invention is shown.

DETAILED DESCRIPTION OF THE PREFERRED EMBODIMENTS

It appears that the doctor beam 1 has a front side 2 in which is formed a U-shaped channel 3. This channel constitutes a part of the doctor blade chamber. The chamber is furthermore delimited by doctor blades 4 disposed at each side of the U-shaped channel 3. The chamber is delimited by the last side of a print roller 5 used in conjunction with the doctor blade for tranferring ink 3' contained in the U-shaped channel 3.

The beam is made of metal and has a fibre coating 6 at its front side, at least covering the U-shaped channel but extending over the whole front side 2 of the beam in the shown embodiment.

The invention claimed is:

1. A doctor beam for a doctor blade for application in a printing unit, which doctor beam has a front side with a U-shaped channel constituting a part of a doctor blade chamber for receiving an applied ink, wherein the beam is made of metal and has a fibre coating at least covering the U-shaped channel in order thereby to prevent disintegration due to chemical action of the applied ink, and wherein the fibre coating has been applied under use of pressure and temperature to prevent different contraction coefficients during the coating process, and wherein the fibre coating is made from material so that the coating is resistant against pH values over 8, wherein the fibre coating is formed by braided fibre weaving.

2. A doctor beam according to claim 1, wherein the fibre coating comprises carbon fibers.

3. A doctor beam according to claim 1, wherein the fibre coating comprises glass fibers.

4. A doctor beam according to claim 1, wherein the fibre coating extends across all of the front side of the doctor beam.

5. A doctor beam according to claim 1, wherein the fibre coating has a thickness between 0.1 mm and 5 mm.

6. A doctor beam according to claim 1, wherein the doctor beam is made from aluminum.

7. A doctor blade according to claim 1, wherein the metal is aluminum and the fibre coating comprises carbon fibers.

8. A doctor beam according to claim 1, wherein the fibre coating has a thickness between 0.5 mm and 1.5 mm.

9. The doctor beam of claim 1, wherein the fiber coating is a carbon fiber and epoxy resin coating.

10. A doctor beam for a doctor blade for application in a printing unit, which doctor beam has a front side with a U-shaped channel constituting a part of a doctor blade chamber for receiving an applied ink, wherein the beam is made of metal and has a fibre coating at least covering the U-shaped channel in order thereby to prevent disintegration due to chemical action of the applied ink, and wherein the fibre coating has been applied under use of pressure and temperature to prevent different contraction coefficients during the coating process, and wherein the fibre coating is made from material so that the coating is resistant against pH values over 8, wherein the fibre coating comprises a carbon fiber composite having the following properties: Young's modulus of 140,000 N/mm$^2$; specific weight of 1540 kg/m$^3$; Poisson ration of 0.28; Tensile strength of 225,000 psi; compressive strength of 129,000 psi; secure operating temperature of 55–80° C.

11. The doctor beam of claim 10, wherein the fibre coating extends across the front side of the doctor beam.

12. The doctor beam of claim 10, wherein the fibre coating has a thickness between 0.1 mm and 5 mm.

13. The doctor beam of claim 10, wherein the fibre coating has a thickness between 0.5 mm and 1.5 mm.

14. The doctor beam of claim 10, wherein the metal is aluminum.

15. The doctor blade according to claim 10, wherein the metal is aluminum and the fibre coating comprises carbon fibers.

16. A doctor beam for a doctor blade for application in a printing unit, which doctor beam has a front side with a U-shaped channel constituting a part of a doctor blade chamber for receiving an applied ink, wherein the beam is made of metal and has a fibre coating at least covering the U-shaped channel in order thereby to prevent disintegration due to chemical action of the applied ink, and wherein the fibre coating has been applied under use of pressure and temperature to prevent different contraction coefficients during the coating process, and wherein the fibre coating is made from material so that the coating is resistant against pH values over 8, wherein the fiber coating has an operating temperature up to 80° C.

17. The doctor beam of claim 10, wherein the fibre coating is selected from the group consisting of carbon fibers, glass fibers, braided fibre weaving, and combinations thereof.

* * * * *